US008839604B2

(12) United States Patent
Rodatz et al.

(10) Patent No.: US 8,839,604 B2
(45) Date of Patent: Sep. 23, 2014

(54) METHOD AND APPARATUS FOR OPERATING AN INTERNAL COMBUSTION ENGINE

(75) Inventors: Paul Rodatz, Landshut (DE); Sebastian Viehöver, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 949 days.

(21) Appl. No.: 12/971,071

(22) Filed: Dec. 17, 2010

(65) Prior Publication Data

US 2011/0146238 A1 Jun. 23, 2011

(30) Foreign Application Priority Data

Dec. 18, 2009 (DE) ..... 10 2009 058 780

(51) Int. Cl.
*F01N 3/00* (2006.01)
*F02D 41/14* (2006.01)

(52) U.S. Cl.
CPC ..... *F02D 41/1401* (2013.01); *F02D 41/1456* (2013.01); *F02D 2041/1409* (2013.01); *F02D 2041/1422* (2013.01); *F02D 41/1483* (2013.01); *F02D 41/1482* (2013.01); *F02D 41/1441* (2013.01)
USPC ..... 60/285; 60/274; 60/276

(58) Field of Classification Search
USPC ..... 60/274, 276, 285
See application file for complete search history.

(56) References Cited

U.S. PATENT DOCUMENTS

| | | | | |
|---|---|---|---|---|
| 5,115,639 | A * | 5/1992 | Gopp | 60/274 |
| 5,317,868 | A * | 6/1994 | Blischke et al. | 60/274 |
| 5,337,557 | A * | 8/1994 | Toyoda | 60/276 |
| 5,637,276 | A * | 6/1997 | Carnevale et al. | 422/94 |
| 5,787,867 | A * | 8/1998 | Schnaibel et al. | 123/674 |
| 7,131,261 | B2 * | 11/2006 | Wackerow et al. | 60/277 |
| 7,431,025 | B2 * | 10/2008 | Cianciara et al. | 123/696 |
| 2004/0000135 | A1 * | 1/2004 | Uchida | 60/277 |
| 2008/0009997 | A1 * | 1/2008 | Ketterer et al. | 701/101 |
| 2011/0041819 | A1 | 2/2011 | Rodatz et al. | |

FOREIGN PATENT DOCUMENTS

DE 102008018013 B3 7/2009 ..... F02D 41/14

* cited by examiner

*Primary Examiner* — Thomas Denion
*Assistant Examiner* — Diem Tran
(74) *Attorney, Agent, or Firm* — King & Spalding L.L.P.

(57) ABSTRACT

In a method and apparatus for operating an internal combustion engine, a lambda control is carried out, in which a trim regulation is provided, which operates with a P regulator component and an I regulator component. To prevent overshooting when the trim regulation is carried out, operation takes place in a first mode with compulsory adjustment and in a following second mode with increased regulator amplification factors.

20 Claims, 4 Drawing Sheets

METHOD AND APPARATUS FOR OPERATING AN INTERNAL COMBUSTION ENGINE

CROSS-REFERENCE TO RELATED APPLICATIONS

This application claims priority to DE patent application No. 10 2009 058 780.2 filed Dec. 18, 2009. The contents of which is incorporated herein by reference in its entirety.

TECHNICAL FIELD

The present invention relates to a method for operating an internal combustion engine having at least one cylinder, to which an injection valve for metering in fuel is assigned, with an exhaust tract, in which an exhaust gas catalytic converter is disposed, a first exhaust gas probe which is disposed upstream of the exhaust gas catalytic converter and a second exhaust gas probe which is disposed downstream of the exhaust gas catalytic converter, a lambda control being provided, the controlled variable of which is determined as a function of a measuring signal from the first exhaust gas probe and the actuating variable of which acts on a fuel mass to be metered in by means of the injection valve, with a trim regulation also being provided, the controlled variable of which is determined as a function of a measuring signal from the second exhaust gas probe and the first trim actuating variable of which is determined as a function of a P regulator component of the trim regulation and the second trim actuating variable of which is determined as a function of an I regulator component of the trim regulation.

BACKGROUND

A specific lambda value must be provided as a mean for optimum exhaust gas conversion. In current exhaust gas systems, as featured by the internal combustion engine described above, the measuring signal of the first exhaust gas probe upstream of the catalytic converter is used as a reference variable (controlled variable) for the lambda control. The measuring signal of the second exhaust gas probe downstream of the catalytic converter is used in a trim regulation to correct the lambda control. The trim regulation here serves to monitor the catalytic conversion and fine regulation of the fuel/air mixture. The trim regulation here is generally made up of a P regulator component and an I regulator component. The I regulator component here is intended to compensate for a lasting system deviation produced by displacements of the characteristic curves of the first exhaust gas probe. Such displacements of characteristic curves can result from ageing and/or dirt. The I regulator component is also designed to be correspondingly slow so as not to react to short-term problems (for example tank venting).

Where the characteristic curve is subject to sudden changes (e.g. contamination, after a probe change or after deletion of the adaptation values) the I component will only correct the deviation slowly. During this period the P component has to correct the system deviation. In contrast to the I component the P component is however only included in the calculation in certain operating states. This means that a characteristic curve displacement is not continuously corrected, resulting in an increase in emissions.

Sudden or rapid changes to the system deviation can therefore only be learned and adapted during a longer trip. Increased emissions must be assumed during this time.

An internal combustion engine of the type described in the introduction is known from DE 10 2008 018 013 B3. To eliminate the problem set out above it is proposed in this publication that the P component of the trim regulator should be observed and if the P component exceeds (in the case of positive regulator intervention) or drops below (in the case of negative regulator intervention) an applicable threshold for the duration of an air mass integral or a period, the I component should be compulsorily adjusted. To this end an amount dependent on the P component or the voltage of the second exhaust gas probe is added to the I component. This allows rapid adjustment of the I component to be achieved in the event of major regulator deviations. However the functionality tends toward overshooting. The non-linearity of the characteristic curve of the second exhaust gas probe and ageing effects mean that the association between the probe voltage and the actual deviation of the central position of the mixture is difficult to determine. Relatively major errors occur with small to medium deviations. The neutral position can therefore only be roughly achieved when there is a sudden adjustment of the I component.

SUMMARY

According to various embodiments, a method of the type described in the introduction can be created, with which it is possible to achieve particularly low-emission operation of an internal combustion engine.

According to an embodiment, in a method for operating an internal combustion engine having at least one cylinder, to which an injection valve for metering in fuel is assigned, with an exhaust tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control being provided, the controlled variable of which is determined as a function of a measuring signal from the first exhaust gas probe and the manipulated variable of which acts on a fuel mass to be metered in by means of the injection valve, with a trim regulation also being provided, the controlled variable of which is determined as a function of a measuring signal from the second exhaust gas probe and the first trim control variable of which is determined as a function of a P regulator component of the trim regulation and the second trim control variable of which is determined as a function of an I regulator component of the trim regulation, wherein when a first threshold is exceeded by the first trim control variable (of the P component or an equivalent parameter), the second trim control variable (the I component or equivalent parameter) is compulsorily adjusted (first mode), when the first trim control variable drops below a second threshold, which is smaller than the first threshold, a switch is made to a second mode, in which the regulator amplification factors of the second trim control variable are increased, and when the first trim control variable drops below a third threshold, the amount of which is smaller than the first and second thresholds, a switch is made from the second mode and the calculation of the second trim control variable is carried out in a regular manner.

According to another embodiment, in a method for operating an internal combustion engine having at least one cylinder, to which an injection valve for metering in fuel is assigned, with an exhaust tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control being provided, the controlled variable of which is determined as a function of a measuring signal from the first exhaust gas probe and the manipulated variable of which acts on a fuel mass to be metered in by means of the injection valve, with a trim regulation also being provided, the controlled variable of which is determined as a function of a measuring signal from the second exhaust gas probe and the first trim control variable of which is determined as a function of a P regulator component of the trim regulation and the second trim control variable of which is determined as a function of an I regulator component of the trim regulation, wherein when a fourth threshold is exceeded by the first trim control variable (of the P component or equivalent parameter), a switch is made to a second mode in which the regulator amplification factors of the second trim control variable (of the I component or equivalent parameter) are increased, and when the first trim control variable drops below a third threshold, the amount of which is smaller than the fourth threshold, a switch is made from the second mode and the calculation of the second trim control variable is carried out in a regular manner.

According to further embodiments of any of the above methods, the amount of the increase in the regulator amplification factors can be fixed or a function of the first trim control variable. According to further embodiments of any of the above methods, the two acceleration modes can be terminated after a maximum activation period.

According to yet another embodiment, an apparatus for operating an internal combustion engine having at last one cylinder, to which an injection valve for metering in fuel is assigned, with an exhaust gas tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control being provided, the controlled variable of which is determined as a function of a measuring signal from a first exhaust gas probe and the manipulated variable of which acts on a fuel mass to be metered in by means of the injection valve, with a trim regulation also being provided, the controlled variable of which is determined as a function of a measuring signal from the second exhaust gas probe and the first trim control variable of which is determined as a function of a P regulator component of the trim regulation and the second trim control variable of which is determined as a function of an I regulator component of the trim regulation, wherein the apparatus is configured so that when a first threshold is exceeded by the first trim control variable (of the P component or an equivalent parameter), the second trim control variable (the I component or equivalent parameter) is compulsorily adjusted (first mode), when the first trim control variable drops below a second threshold, which is smaller than the first threshold, a switch is made to a second mode, in which the regulator amplification factors of the second trim control variable are increased, and when the first trim control variable drops below a third threshold, the amount of which is smaller than the first and second thresholds, a switch is made from the second mode and the calculation of the second trim control variable is carried out in a regular manner.

According to yet another embodiment, an apparatus for operating an internal combustion engine having at last one cylinder, to which an injection valve for metering in fuel is assigned, with an exhaust gas tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control being provided, the controlled variable of which is determined as a function of a measuring signal from a first exhaust gas probe and the manipulated variable of which acts on a fuel mass to be metered in by means of the injection valve, a trim regulation also being provided, the controlled variable of which is determined as a function of a measuring signal from the second exhaust gas probe and the first trim control variable of which is determined as a function of a P regulator component of the trim regulation and the second trim control variable of which is determined as a function of an I regulator component of the trim regulation, wherein the apparatus is configured so that when a fourth threshold is exceeded by the first trim control variable (of the P component or equivalent parameter) a switch is made to a second mode, in which the regulator amplification factors of the second trim control variable (of the I component or equivalent parameter) are increased, and when the first trim control variable drops below a third threshold, the amount of which is smaller than the fourth threshold, a switch is made from the second mode and the calculation of the second trim control variable is carried out in a regular manner.

BRIEF DESCRIPTION OF THE DRAWINGS

The invention is described in detail below based on an exemplary embodiment in conjunction with the drawing, in which.

DETAILED DESCRIPTION

Figure 1:
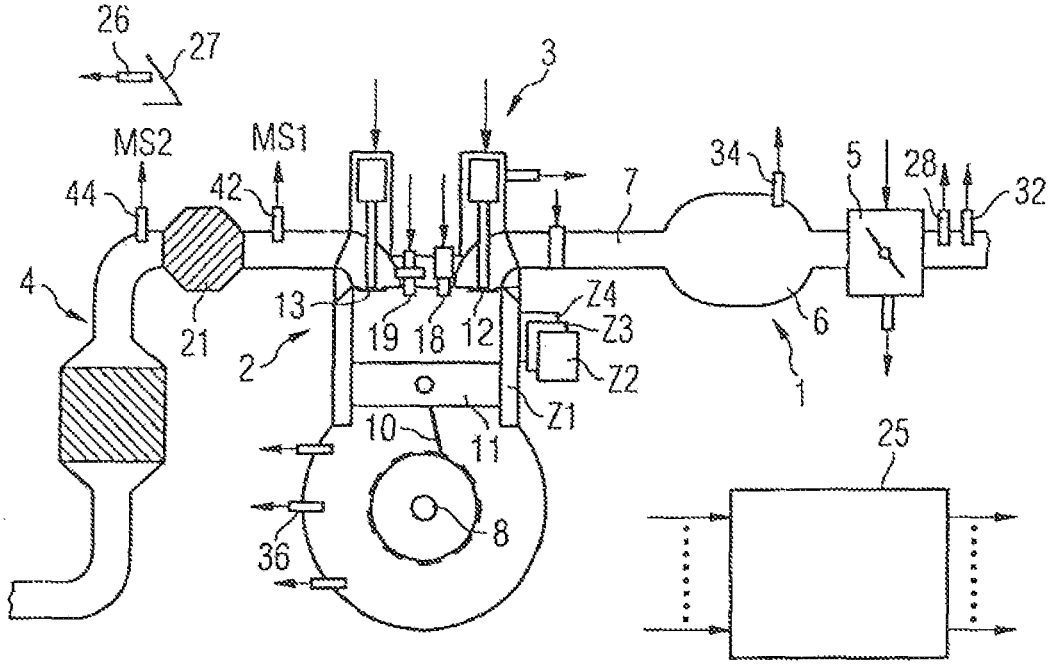
FIG. 1 shows a schematic diagram of an internal combustion engine with control apparatus.

As stated above, according to an embodiment, in a method of the stated type, when a first threshold is exceeded by the first trim actuating variable (of the P component or an equivalent parameter) the second trim actuating variable (the I component or an equivalent parameter) is compulsorily adjusted (first mode), when the first trim actuating variable (of the P component or equivalent parameter) drops below a second threshold, which is smaller than the first threshold, a switch is made to a second mode, in which the regulator amplification factors of the second trim actuating variable (of the I component or equivalent parameter) are increased, and when the first trim actuating variable (of the P component or equivalent parameter) drops below a third threshold, the amount of which is smaller than the first and second thresholds, a switch is made from the second mode and the calculation of the second trim actuating variable (of the I component or equivalent parameter) is carried out in a regular manner.

The described solution avoids overshooting due to the compulsory adjustment of the I component. A stepped method is proposed according to various embodiments. If the P component or an equivalent parameter (the first trim actuating variable) based on the voltage of the second exhaust gas probe exceeds the first threshold, the I component or an equivalent parameter (the second trim actuating variable) is compulsorily adjusted in the known manner. Since the change to the I component takes place in the closed control circuit, as the I component increases, the regulator difference becomes smaller and so the P component and the equivalent parameter drop.

If the first trim actuating variable (the P component or equivalent parameter) drops below the second threshold, which is smaller than the first threshold for compulsory adjustment, the second trim actuating variable (the I component or equivalent parameter) is no longer compulsorily adjusted but the method switches to a second mode, which follows the first mode for compulsory adjustment. In this second mode the regulator amplification factors of the second trim actuating variable (of the I component or equivalent parameter) are increased. In this second mode the I component is therefore incremented more rapidly than in regular operation. However since there is no sudden adjustment of the I component, it is possible to avoid overshooting.

When the first trim actuating variable (the P component or equivalent parameter) finally drops below a third threshold, the amount of which is smaller than the two other thresholds, a switch is made from the second mode with increased amplification factors and the calculation of the second trim actuating variable (of the I component or equivalent parameter) is carried out in a regular manner.

In a second embodiment of the method, when a fourth threshold is exceeded by the first trim actuating variable (of the P component or equivalent parameter), a switch is made to a second mode in which the regulator amplification factors of the second trim actuating variable (of the I component or equivalent parameter) are increased, and when the first trim actuating variable (the P component or equivalent parameter) drops below a third threshold, the amount of which is smaller than the fourth threshold, a switch is made from the second mode and the calculation of the second trim actuating variable (of the I component or equivalent parameter) is carried out in a regular manner.

The method variant described above is used when the first trim actuating variable (the P component or equivalent parameter) does not exceed the threshold 1 for compulsory adjustment at the start but exceeds a threshold 4, which is between the thresholds 1 and 2. It is then possible to switch directly to the mode with increased amplification factors.

With the method according to various embodiments the amount of the increase in the regulator amplification factors can be fixed or a function of the first trim actuating variable (the P component or equivalent parameter).

It is possible with the method according to various embodiments to terminate both acceleration modes (mode 1=compulsory adjustment, mode 2=increase in amplification factors) after a maximum activation period (by way of time, number of adjustment steps or air mass integral).

According to further embodiments, an apparatus for operating an internal combustion engine having at last one cylinder, to which an injection valve for metering in fuel is assigned, with an exhaust gas tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control being provided, the controlled variable of which is determined as a function of a measuring signal from the first exhaust gas probe and the actuating variable of which acts on a fuel mass to be metered in by means of the injection valve, a trim regulation also being provided, the controlled variable of which is determined as a function of a measuring signal from the second exhaust gas probe and the first trim actuating variable of which is determined as a function of a P regulator component of the trim regulation and the second trim actuating variable of which is determined as a function of an I regulator component of the trim regulation. According to various embodiments the apparatus is configured so that when a first threshold is exceeded by the first trim actuating variable (of the P component or equivalent parameter) it compulsorily adjusts the second trim actuating variable (the I component or equivalent parameter) (first mode), when the first trim actuating variable (of the P component or equivalent parameter) drops below a second threshold, which is smaller than the first threshold, it switches to a second mode, in which the regulator amplification factors of the second trim actuating variable (of the I component or equivalent parameter) are increased, and when the first trim actuating variable (of the P component or equivalent parameter) drops below a third threshold, the amount of which is smaller than the first and second thresholds, it switches from the second mode and carries out the calculation of the second trim actuating variable (of the I component or equivalent parameters) in a regular manner.

In a second variant the apparatus is configured so that when a fourth threshold is exceeded by the first trim actuating variable (of the P component or equivalent parameter), it switches directly to a second mode, in which the regulator amplification factors of the second trim actuating variable (of the I component or equivalent parameter) are increased, and when the first trim actuating variable (the P component or equivalent parameter) drops below a third threshold, the amount of which is smaller than the fourth threshold, it switches from the second mode and carries out the calculation of the second trim actuating variable (of the I component or equivalent parameters) in a regular manner.

The internal combustion engine illustrated in FIG. 1 has an intake tract 1, an engine block 2, a cylinder head 3 and an exhaust gas tract 4. The intake tract 1 preferably comprises a throttle valve 5, also a manifold 6 and an intake pipe 7, which passes to a cylinder Z 1 by way of an inlet duct into the engine block 2. The engine block 2 also comprises a crankshaft 8, which is coupled by way of a piston rod 10 to the piston 11 of the cylinder Z 1.

The cylinder head 3 has a valve drive with a gas inlet valve 12 and a gas outlet valve 13. The cylinder head 3 also comprises an injection valve 18 and a spark plug 19. Disposed in the exhaust gas tract 4 is an exhaust gas catalytic converter 21, which is configured for example as a three-way catalytic converter. Also disposed in the exhaust gas tract 4 for example is a further exhaust gas catalytic converter, which is configured as a NOX catalytic converter.

A control apparatus 25 is provided, to which sensors are assigned, which detect the various measured variables and in each instance determine the value of the measured variable.

The control apparatus 25 is configured to determine actuating variables as a function of at least one of the measured variables, said actuating variables then being converted to one or more control signals for controlling the final control elements by means of corresponding actuators.

The sensors are a pedal position sensor 26 which detects a gas pedal position of a gas pedal 27, an air mass sensor 28 which detects an air mass flow upstream of the throttle valve 5, a first temperature sensor 32 which detects an intake air temperature, an intake pipe pressure sensor 34 which detects an intake pipe pressure in the manifold 6, a crankshaft angle sensor 36 which detects a crankshaft angle, to which a rotational speed N is then assigned.

A first exhaust gas probe (pre-cat probe) 42 is also provided, being disposed upstream of the exhaust gas catalytic converter 21 or in the exhaust gas catalytic converter 21 and detecting a residual oxygen content of the exhaust gas, its measuring signal MS 1 being characteristic of the air/fuel ratio in the combustion chamber of the cylinder upstream of the first exhaust gas probe 42 before fuel oxidation. A second exhaust gas probe (post-cat probe) 44 is also disposed downstream of the exhaust gas catalytic converter 21, being deployed in particular on the context of trim regulation, its measuring signal being designated as MS 2.

The mode of operation of the control apparatus 25 is described in detail in the above-mentioned DE 10 2008 018 013 B3. Only the features of significance for various embodiments are described below.

Figure 2:
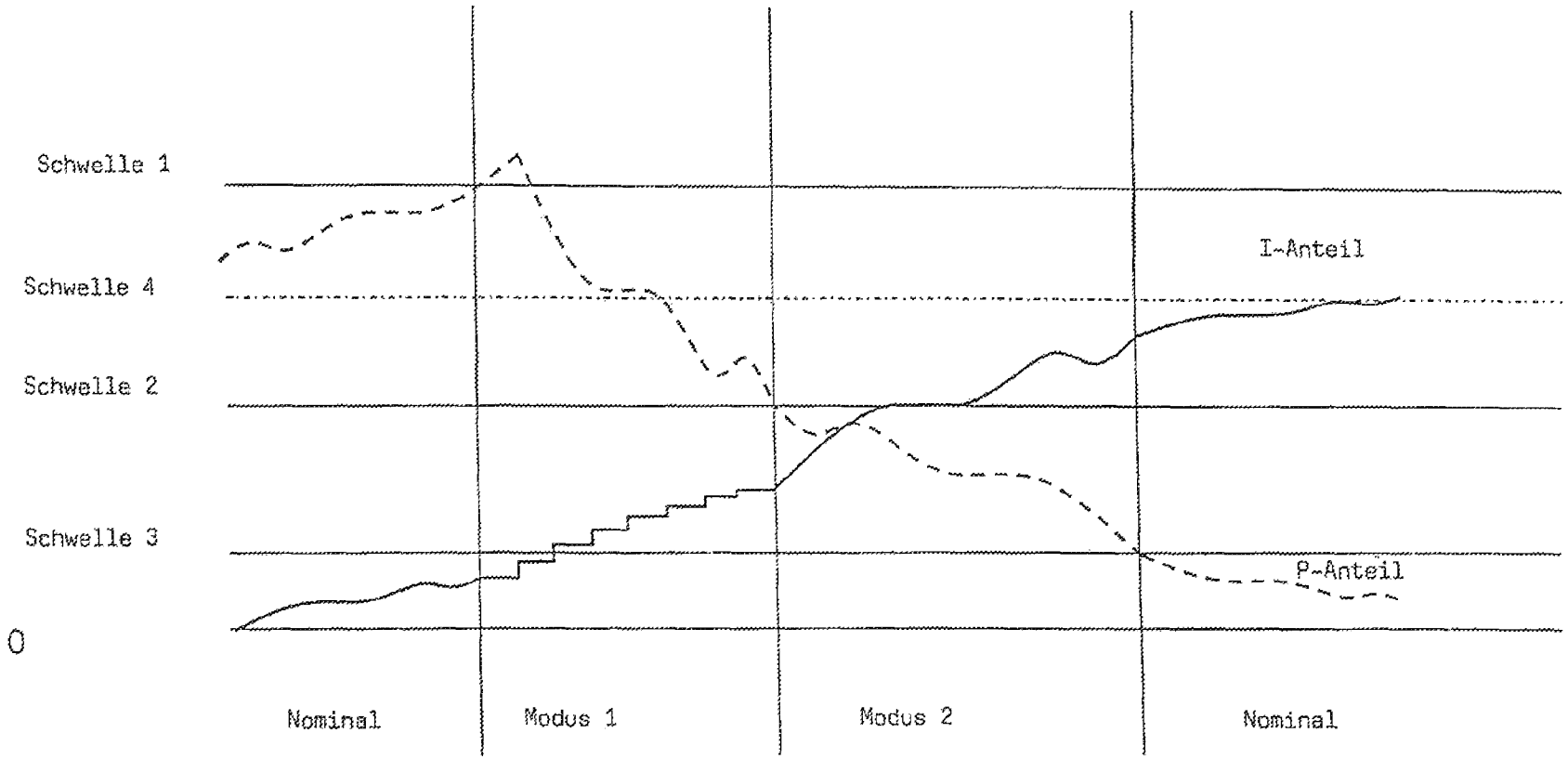
FIG. 2 shows the change to the P component and I component in a first variant of the method according to various embodiments.

With the lambda regulation carried out here a trim regulation is undertaken, the controlled variable of which is determined as a function of the measuring signal MS 2 of the second exhaust gas probe 44 and the first trim actuating variable of which is determined as a function of a P regulator component of the trim regulation or an equivalent parameter and the second trim actuating variable of which is determined as a function of an I regulator component of the trim regulation or an equivalent parameter. The further procedure of this trim regulation is illustrated in a first method variant in FIG. 2. When a first threshold is exceeded by the first trim actuating variable (P component or equivalent parameter), the second trim actuating variable (I component or equivalent parameter) is compulsorily adjusted (first mode). When the first trim actuating variable (P component or equivalent Parameter) drops below a second threshold, which is smaller than the first threshold, the method switches to a second mode, in which the regulator amplification factors of the second trim actuating variable (I component or equivalent parameter) are increased. When the first trim actuating variable drops below a third threshold, the amount of which is smaller than the first and second thresholds, a switch is made from the second mode and the calculation of the second trim actuating variable is again carried out in a regular manner. FIG. 2 shows the profile of the first trim actuating variable (P component) with a broken line, while the profile of the second trim actuating variable (I component) is shown with a continuous line. Since there is no sudden adjustment of the I component with this procedure, it is possible to avoid overshooting.

Figure 3:
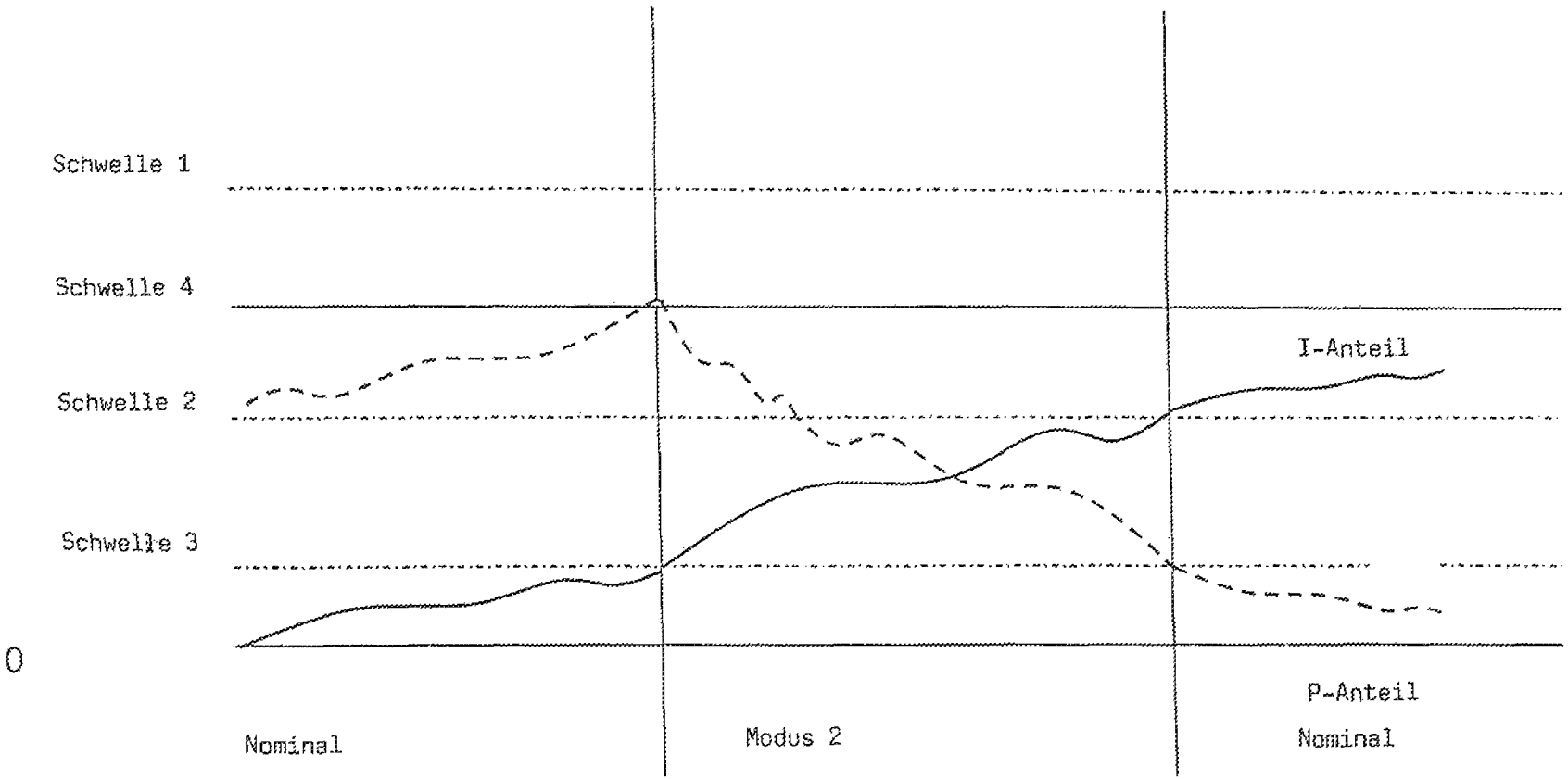
FIG. 3 shows the change to the P component and I component in a second variant of the method according to various embodiments.

The procedure with the second variant is illustrated in FIG. 3. Here too the broken line shows the profile of the first trim actuating variable (of the P component), while the continuous line shows the profile of the second trim actuating variable (of the I component). If the first trim actuating variable (the P component or equivalent parameter) does not exceed the first threshold for compulsory adjustment at the start but does exceed a fourth threshold, which is between the first threshold and the second thresholds, a direct switch is made to the second mode with increased factors. There is then a transition back to regular operation as with the first variant.

Figure 4:
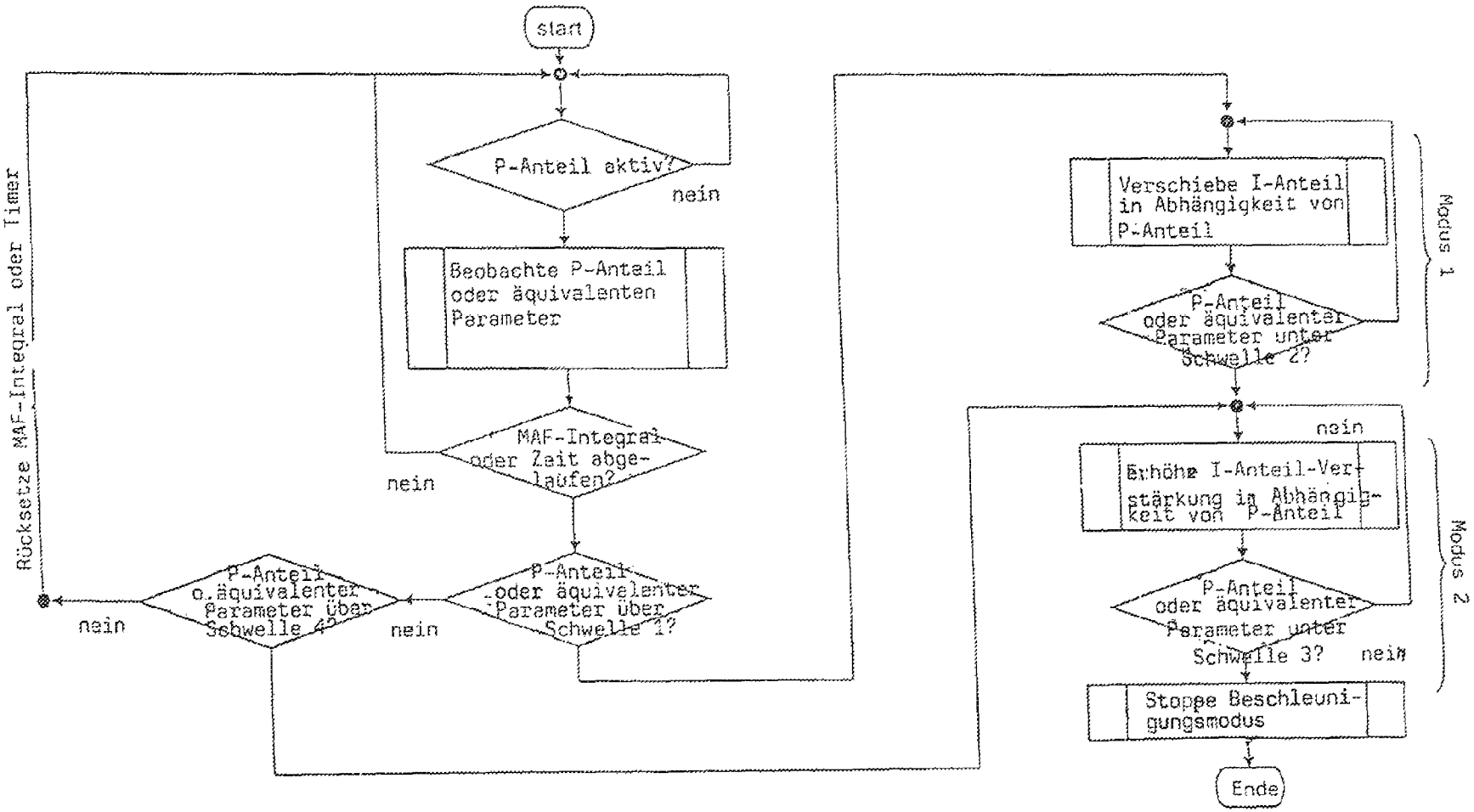
FIG. 4 shows a flow diagram of the first variant of the method according to various embodiments.

FIG. 4 shows a flow diagram for the first method variant.

What is claimed is:

1. A method for operating an internal combustion engine having at least one cylinder, to which an injection valve for metering in fuel is assigned, with an exhaust tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control, and a trim regulation, the method comprising:

determining a controlled variable of the lambda control as a function of a measuring signal from the first exhaust gas probe wherein an actuating variable of the lambda control acts on a fuel mass to be metered in by means of the injection valve, determining a controlled variable of the trim regulation as a function of a measuring signal from the second exhaust gas probe and determining a first trim actuating variable of the trim regulation as a function of a P regulator component of the trim regulation and a second trim actuating variable of the trim regulation as a function of an I regulator component of the trim regulation, wherein in a first mode when a first threshold is exceeded by the first trim actuating variable, the second trim actuating variable is compulsorily adjusted, wherein when the first trim actuating variable drops below a second threshold, which is smaller than the first threshold, a switch is made to a second mode, in which the regulator amplification factors of the second trim actuating variable are increased, and wherein when the first trim actuating variable drops below a third threshold, the amount of which is smaller than the first and second thresholds, a switch is made from the second mode and the calculation of the second trim actuating variable is carried out in a regular manner.

2. The method according to claim 1, wherein the first trim actuating variable is the P component or an equivalent parameter.

3. The method according to claim 1, wherein the second trim actuating variable is the I component or an equivalent parameter.

4. The method according to claim 1, wherein the amount of the increase in the regulator amplification factors is fixed or is a function of the first trim actuating variable.

5. The method according to claim 1, wherein the two acceleration modes are terminated after a maximum activation period.

6. A method for operating an internal combustion engine having at least one cylinder, to which an injection valve for metering in fuel is assigned, an exhaust tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, a lambda control, and a trim regulation, the method comprising:

determining the controlled variable of the lambda control as a function of a measuring signal from the first exhaust gas probe wherein the actuating variable of the lambda control acts on a fuel mass to be metered in by means of the injection valve, determining the controlled variable of the trim regulation as a function of a measuring signal from the second exhaust gas probe and determining the first trim actuating variable of the trim regulation as a function of a P regulator component of the trim regulation and determining the second trim actuating variable of the trim regulation as a function of an I regulator component of the trim regulation, wherein in a first mode when a fourth threshold is exceeded by the first trim actuating variable, a switch is made to a second mode in which the regulator amplification factors of the second trim actuating variable are increased, and wherein when the first trim actuating variable drops below a third threshold, the amount of which is smaller than the fourth threshold, a switch is made from the second mode and the calculation of the second trim actuating variable is carried out in a regular manner.

7. The method according to claim 6, wherein the first trim actuating variable is of the P component or an equivalent parameter.

8. The method according to claim 6, wherein the second trim actuating variable is of the I component or an equivalent parameter.

9. The method according to claim 6, wherein the amount of the increase in the regulator amplification factors is fixed or is a function of the first trim actuating variable.

10. The method The method according to claim 6, wherein the two acceleration modes are terminated after a maximum activation period.

11. An apparatus for operating an internal combustion engine having at last one cylinder, to which an injection valve for metering in fuel is assigned, with an exhaust gas tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, comprising a lambda control, the controlled variable of which is determined as a function of a measuring signal from a first exhaust gas probe and the actuating variable of which acts on a fuel mass to be metered in by means of the injection valve, and a trim regulation, the controlled variable of which is determined as a function of a measuring signal from the second exhaust gas probe and the first trim actuating variable of which is determined as a function of a P regulator component of the trim regulation and the second trim actuating variable of which is determined as a function of an I regulator component of the trim regulation, wherein the apparatus is configured such that in a first mode when a first threshold is exceeded by the first trim actuating variable, the second trim actuating variable is compulsorily adjusted, and when the first trim actuating variable drops below a second threshold, which is smaller than the first threshold, a switch is made to a second mode, in which the regulator amplification factors of the second trim actuating variable are increased, and when the first trim actuating variable drops below a third threshold, the amount of which is smaller than the first and second thresholds, a switch is made from the second mode and the calculation of the second trim actuating variable is carried out in a regular manner.

12. The apparatus according to claim 11, wherein the first trim actuating variable is of the P component or an equivalent parameter.

13. The apparatus according to claim 11, wherein the second trim actuating variable is of the I component or an equivalent parameter.

14. The apparatus according to claim 11, wherein the amount of the increase in the regulator amplification factors is fixed or is a function of the first trim actuating variable.

15. The apparatus according to claim 11, wherein the apparatus is operable to terminate the two acceleration modes after a maximum activation period.

16. An apparatus for operating an internal combustion engine having at last one cylinder, to which an injection valve for metering in fuel is assigned, with an exhaust gas tract, in which an exhaust gas catalytic converter is disposed, a first exhaust gas probe which is disposed upstream of or in the exhaust gas catalytic converter and a second exhaust gas probe which is disposed downstream of the exhaust gas catalytic converter, comprising:

a lambda control, the controlled variable of which is determined as a function of a measuring signal from a first exhaust gas probe and the actuating variable of which acts on a fuel mass to be metered in by means of the injection valve, and a trim regulation, the controlled variable of which is determined as a function of a measuring signal from the second exhaust gas probe and the first trim actuating variable of which is determined as a function of a P regulator component of the trim regulation and the second trim actuating variable of which is determined as a function of an I regulator component of the trim regulation, wherein the apparatus is configured such that when a fourth threshold is exceeded by the first trim actuating variable a switch is made to a second mode, in which the regulator amplification factors of the second trim actuating variable are increased, and when the first trim actuating variable drops below a third threshold, the amount of which is smaller than the fourth threshold, a switch is made from the second mode and the calculation of the second trim actuating variable is carried out in a regular manner.

17. The apparatus according to claim 16, wherein the first trim actuating variable is of the P component or an equivalent parameter.

18. The apparatus according to claim 16, wherein the second trim actuating variable is of the I component or an equivalent parameter.

19. The apparatus according to claim 16, wherein the amount of the increase in the regulator amplification factors is fixed or is a function of the first trim actuating variable.

20. The apparatus according to claim 16, wherein the apparatus is operable to terminate the two acceleration modes after a maximum activation period.

* * * * *